US008209940B2

(12) United States Patent
Tsumura

(10) Patent No.: US 8,209,940 B2
(45) Date of Patent: Jul. 3, 2012

(54) WASTE SEALING APPARATUS

(75) Inventor: Takehiro Tsumura, Iga (JP)

(73) Assignee: Sumiron Co., Ltd., Osaka-shi, Osaka (JP)

( * ) Notice: Subject to any disclaimer, the term of this patent is extended or adjusted under 35 U.S.C. 154(b) by 22 days.

(21) Appl. No.: 12/903,903

(22) Filed: Oct. 13, 2010

(65) Prior Publication Data

US 2012/0090282 A1 Apr. 19, 2012

(51) Int. Cl.
*B65B 57/12* (2006.01)
*B65B 9/02* (2006.01)

(52) U.S. Cl. ..... 53/58; 53/493; 53/526; 53/528; 53/553

(58) Field of Classification Search ..... 53/55, 58, 53/493, 523, 526, 528, 553–555; *B65B 9/02, B65B 57/12*
See application file for complete search history.

(56) References Cited

U.S. PATENT DOCUMENTS

| | | | | |
|---|---|---|---|---|
| 3,397,505 | A * | 8/1968 | Critchell | 53/551 |
| 3,446,328 | A * | 5/1969 | Boyce et al. | 53/553 |
| 6,145,283 | A * | 11/2000 | Noordenbos et al. | 53/554 |
| 7,603,831 | B2 * | 10/2009 | Sperry et al. | 53/553 |
| 2006/0283153 | A1 * | 12/2006 | Nakano | 53/553 |

FOREIGN PATENT DOCUMENTS

| | | | |
|---|---|---|---|
| DE | 102005055227 | A1 * | 5/2007 |
| JP | 03256804 | A * | 11/1991 |
| JP | 04154506 | A * | 5/1992 |
| JP | 3069593 | U | 3/2000 |
| JP | 2005145562 | A * | 6/2005 |
| JP | 2007217028 | A * | 8/2007 |
| JP | 4066000 | B2 | 1/2008 |
| JP | 2009051509 | A * | 3/2009 |

* cited by examiner

*Primary Examiner* — Stephen F Gerrity
(74) *Attorney, Agent, or Firm* — Hahn & Voight PLLC; Roger C. Hahn

(57) ABSTRACT

A waste sealing apparatus includes a supply mechanism of opposed sealing sheets, a pressure bonding mechanism therefor, a throw-in checking sensor provided on an insertion side of the pressure bonding mechanism, a cutting mechanism for the opposed sealing sheets, a passage checking sensor provided on a discharge side of the pressure bonding mechanism, and a catch-in preventing sensor provided on the discharge side of the pressure bonding mechanism. The pressure bonding mechanism has opposed bonding rolls each having seal parts on its both ends and a elastic compression part therebetween. Detecting a waste by the throw-in checking sensor automatically activates the supply mechanism of opposed sealing sheets. With the pressure bonding mechanism, the bonding rolls to bond opposed sealing sheets to seal the waste. When the passage checking sensor detects the waste from the bonding mechanism, the cutting mechanism automatically cut the sealing sheets. Wastes are automatically sealed not to emit unpleasant smells and bacteria, and the bonded sealing sheets are automatically cut from one end to the other, and the cutting blade is prevented from rusting.

8 Claims, 16 Drawing Sheets

WASTE SEALING APPARATUS

BACKGROUND OF THE INVENTION

1. Field of the Invention

The present invention relates to a waste sealing apparatus for garbage, used diapers, medical wastes, and other waste materials.

2. Description of the Related Art

Up to now, in a hospital, a nursing and healthcare facility for elderly people and the like, nurses and staff members visit rooms of patients and elderly people to change their diapers. There is, for example, Japanese Utility Model Publication No. 3069593 (FIG. 7) which discloses a diaper changing cart used for carrying unused diapers and towels for changing diapers of patients and elderly people and for collecting and discarding the changed and used diapers and towels.

As shown in FIG. 15, this diaper changing cart 51 stores clean unused disposal diapers, disposal pads, cloth diapers and towel in a clean stuff storage 52. The door 54 provided on a front face of a cart main body 53 is rotatably opened so that a pedestal 55 is slidably pulled out. On a frame 57 is attached a plastic bag 56 in which used disposal diapers and cloth diapers are dumped. This diaper changing cart being carried around to patients' rooms, a nurse changes diapers there, opens a lid 58, dumps changed diapers or used towels in the plastic bag 56.

However, there has been a problem that unpleasant smells float around from wastes such as used diapers and the like while the cart being carried around. Further, in addition to the hospital and the nursing facility for elderly people as described above, there has been a similar problem in a household that unpleasant smells often float around emitted from wastes such as garbage dumped and kept in a plastic garbage box.

In another example of a waste sealing apparatus shown in FIG. 16, after a waste 61 is thrown in through a throw-in port 62, when a cover 63 is closed, an activation switch is turned on, and pressure bonding rolls 64 are rotated to pressure-bond sealing sheets 65 fed in a opposed fashion, whereby the waste is sealed. Then, a lever 66 is manually pulled down to cut the sealing sheets 65. Such apparatus is disclosed, for example, in Japanese Patent No. 4066000 (FIG. 3).

However, in this apparatus, the activation switch is not turned on unless the cover is closed, and the sealing sheets 65 need to be cut manually. Therefore, pathogenic bacteria present on a user's hand are prone to attach to the apparatus, and the staff members cannot work efficiently. In addition, a cutting mechanism of this apparatus cannot cut the sealing sheets 65 at and from an end part thereof, and it takes more time to cut sheets compared with cutting at and from an end part. And cutting blade thereof is exposed, which leads to less safe conditions. Due to the malfunction, the apparatus sometimes cut a waste containing a liquid substance, which leads to the cutting blade's easy rusting.

SUMMARY OF THE INVENTION

It is therefore an object of the present invention to provide a waste sealing apparatus which automatically seals wastes preventing unpleasant smells and germs from emitting around from the wastes, automatically cuts the pressure bonded sealing sheets from one end to the other, wherein the cutting blade is unlikely to rust.

In order to achieve the object, the waste sealing apparatus according to the present invention includes a supply mechanism for opposed sealing sheets, a pressure bonding mechanism for the opposed sealing sheets, a throw-in checking sensor provided on an insertion side of the pressure bonding mechanism, a cutting mechanism for the opposed sealing sheets, a passage checking sensor provided on a discharge side of the pressure bonding mechanism, and a catch-in preventing sensor provided on the discharge side of the pressure bonding mechanism. The pressure bonding mechanism for the opposed sealing sheets includes opposed pressure bonding rolls, each of which has seal parts at both ends thereof and an elastic compression part between the seal parts. When the throw-in checking sensor senses a thrown-in waste, the supply mechanism for the opposed sealing sheets is automatically activated. With the pressure bonding mechanism, the pressure bonding rolls presses the opposed sealing sheets to seal the waste. When the passage checking sensor senses the waste discharged from the pressure bonding mechanism, the cutting mechanism automatically performs cutting.

In this waste sealing apparatus, since the throw-in checking sensor is provided on the insertion side of the pressure bonding mechanism, it is possible to sense that the waste is thrown in and activate the pressure bonding mechanism automatically. On the other hand, since the passage checking sensor is provided on the discharge side of the pressure bonding mechanism, it is possible to sense that the waste is discharged and activate the cutting mechanism automatically.

The sealing sheet may include a wrapping base material and a bonding layer (an adhesive layer) formed thereon, and has gas barrier properties in the wrapping base material and the bonding layer (the adhesive layer). Wastes may be wrapped with the wrapping base material and sealed by the bonding layer (the adhesive layer).

The wrapping base material may be a base material made of such as a plastic film and a plastic sheet, which can pass infrared rays therethrough. The gas barrier properties in the wrapping base material and the bonding layer may be obtained by imparting gas barrier properties to the wrapping base material itself, to the bonding layer, or to both of wrapping base material and the bonding layer by the synergistic interaction therebetween. Further, the bonding layer may be an adhesive layer which gives a slightly sticky touch at room temperature.

The catch-in preventing sensor may be linked to a mechanism which stops an operation of the pressure bonding rolls when the catch-in preventing sensor senses that the sealing sheets which seal the waste therebetween have been caught in the pressure bonding rolls.

With this construction, if the sealing sheets and the waste sealed between the sealing sheets are about to be or are caught in one of the opposed pressure bonding rolls, the catch-in preventing sensor senses this condition and generates a signal to the mechanism which stops the rotation of the pressure bonding rolls, so that the rotation of the pressure bonding rolls is stopped and a further catch-in can be prevented.

The cutting mechanism for the sealing sheets may include a cutting blade and opposed attaching gears which support it at the time of cutting. The opposed attaching gears may hold the pressure-bonded sealing sheets therebetween, and the cutting blade associated with the opposed attaching gears may move in a cutting direction.

With this construction, the sealing sheets in a stretched state are sandwiched by the attaching gears, and the cutting blade can reliably cut the pressure-bonded sealing sheets from an end edge to the other end edge thereof, which can reduce the time length required for cutting.

A diameter of the seal parts at the both ends of the pressure bonding rolls may be made larger than the diameter of the elastic compression part between the seal parts.

As in the above-mentioned construction, the pressure bonding mechanism for the opposed sealing sheets includes pressure bonding rolls, and the pressure bonding rolls respectively include seal parts at both ends thereof and an elastic compression part between the seal parts. Therefore, unwanted air remaining between the sealing sheets, which had been present in the waste, can be pushed out by the elastic compression parts of the opposed pressure bonding rolls, and also an excessive volume of the waste can be slightly reduced by compression. Accordingly, in the case where a waste wrapped with a newspaper or the like is thrown in, this can be slightly compressed to have a smaller volume than its original volume. Moreover, the sealing sheets are sealed by the seal parts at the both ends and thus the waste does not squeezed out, and the sealing at the both ends can be secured. Having the elastic compression part, even in the case where a waste is wrapped relatively roughly with a newspaper or the like and thrown in, can reduce the volume of the thrown-in waste.

As the material of the elastic compression part, for example, a urethane-resin or fluoropolymer foam (which can be either a closed cell foam or an open cell foam), which returns to its original shape after deformation, may be used.

The present invention has the construction as described above, the apparatus has various sensors. Therefore, it is possible to provide the waste sealing apparatus which prevents unpleasant smells or germs from floating around and the operation after throwing-in to cutting can be done automatically.

DETAILED DESCRIPTION OF THE PREFERRED EMBODIMENT

Figure 1:
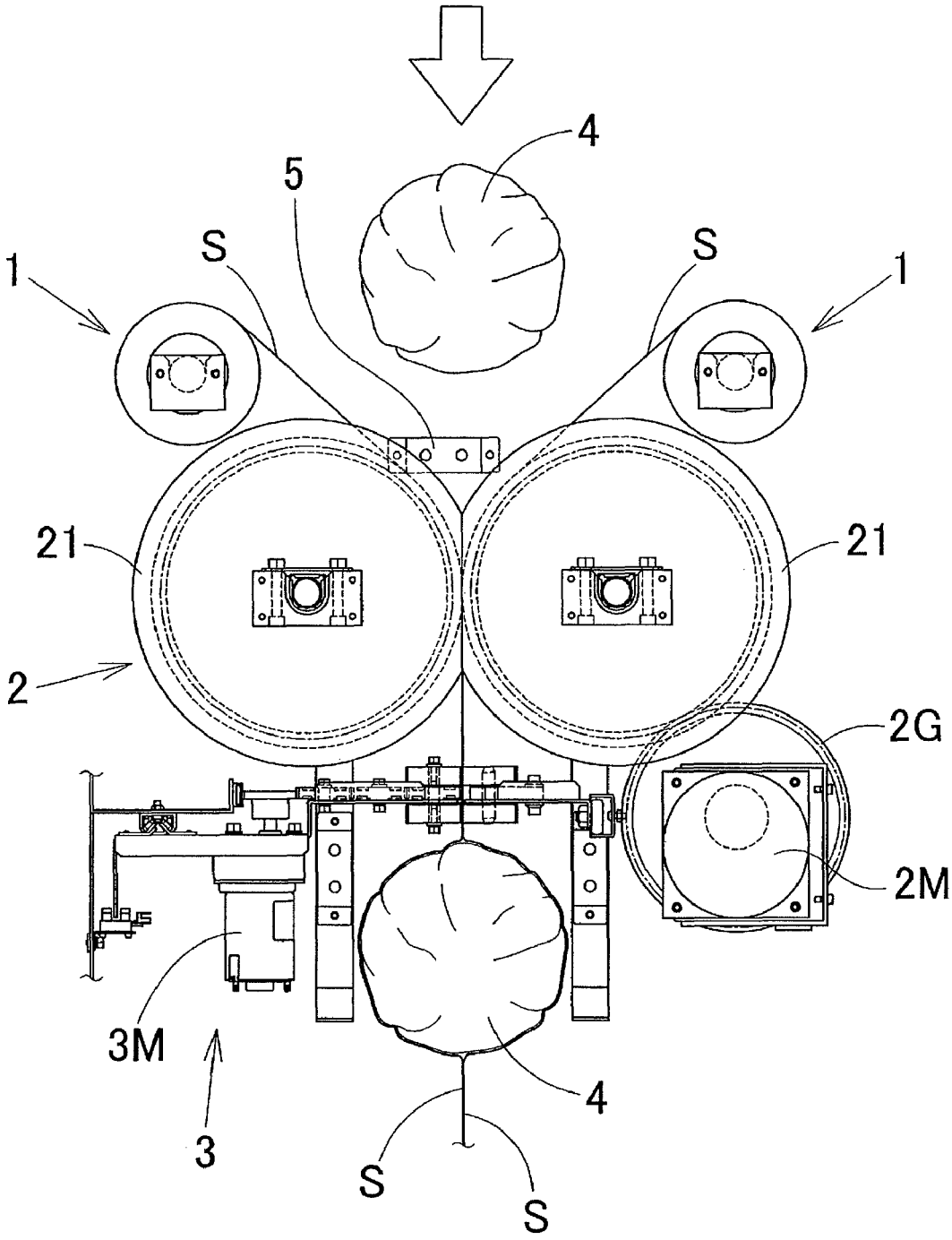
FIG. 1 is a view illustrating a first embodiment of a waste sealing apparatus, especially the features of mechanisms, according to the present invention.
Figure 2:
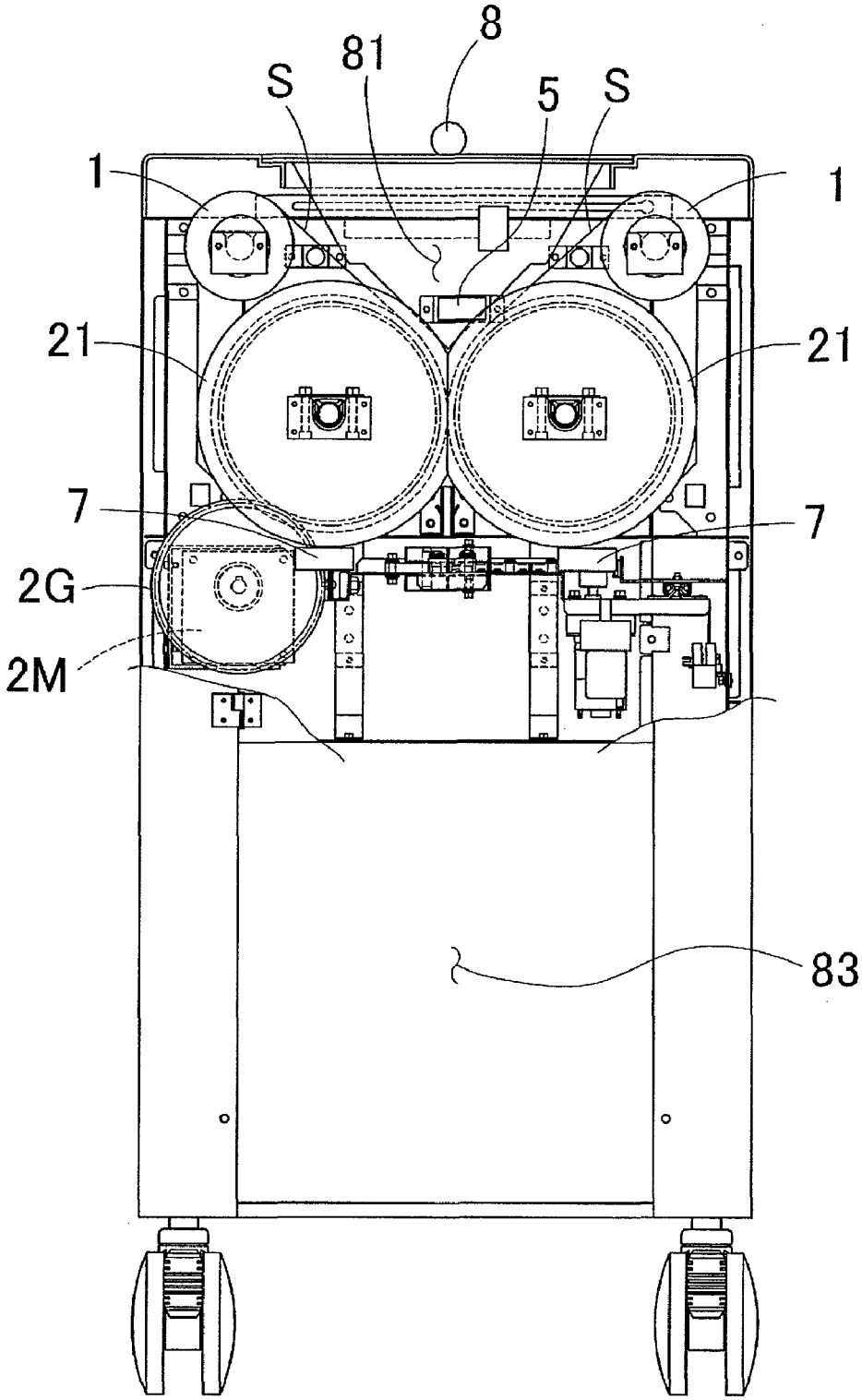
FIG. 2 is a front view of the waste sealing apparatus of FIG. 1.
Figure 3:
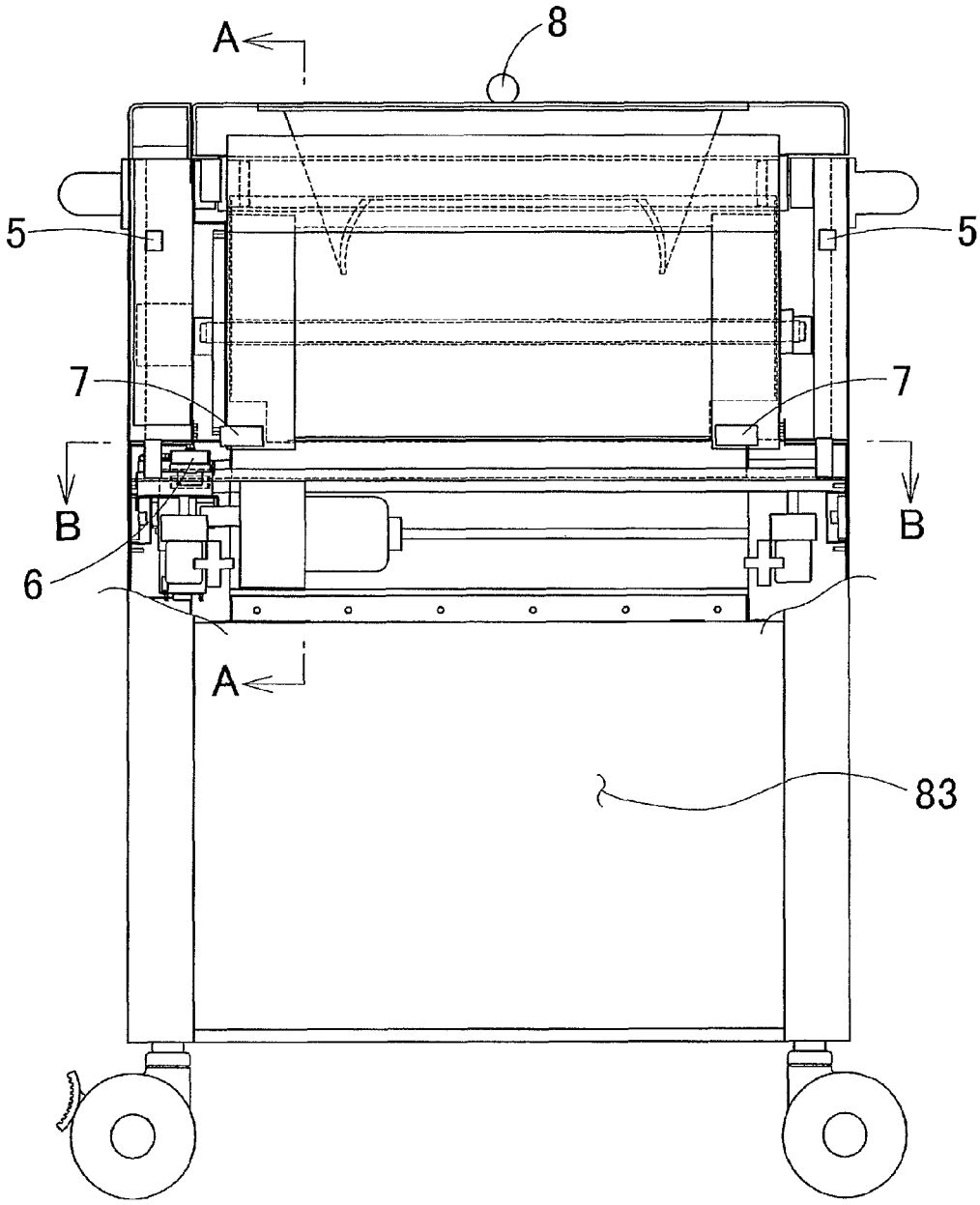
FIG. 3 is a right side view of the waste sealing apparatus of FIG. 1.
Figure 4:
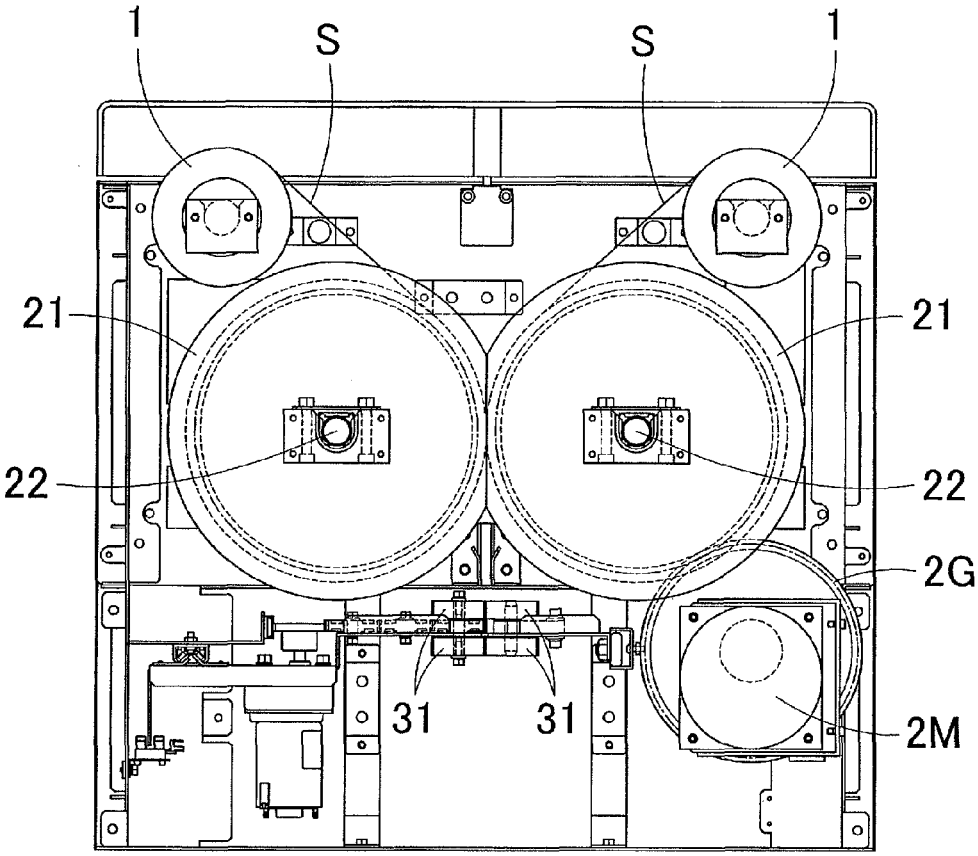
FIG. 4 is a cross sectional view taken along the line A-A of the waste sealing apparatus of FIG. 1.
Figure 5:
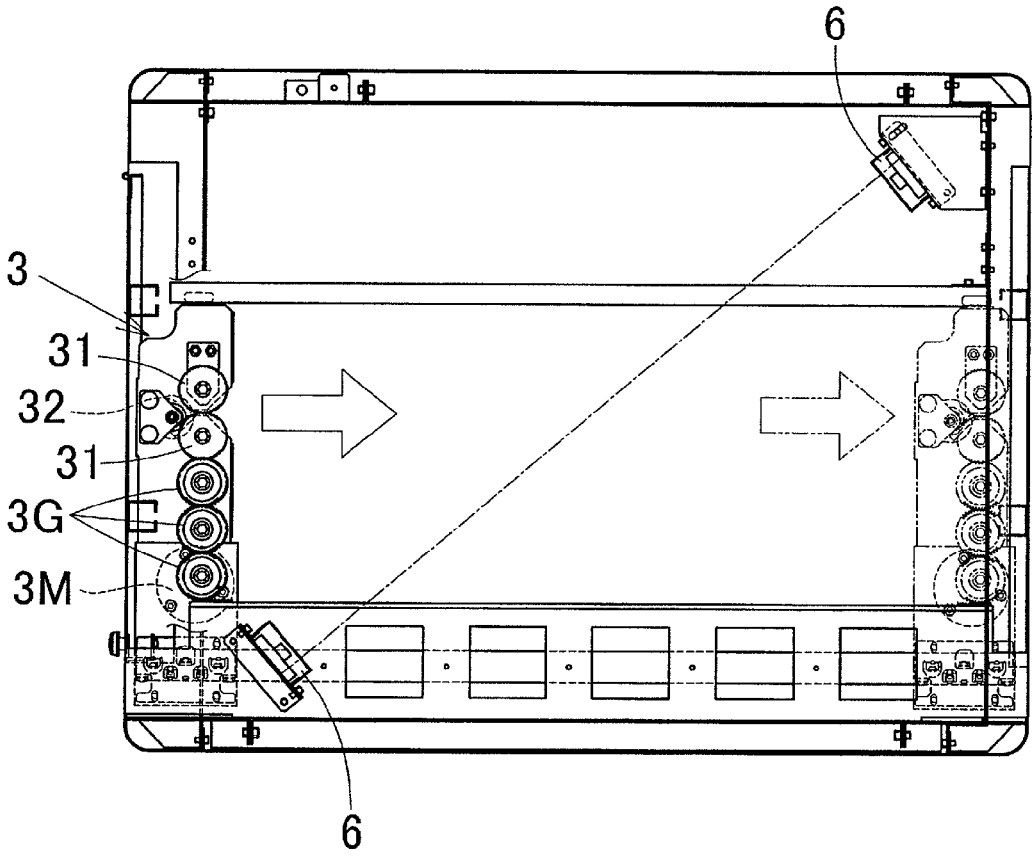
FIG. 5 is a cross sectional view taken along the line B-B of the waste sealing apparatus of FIG. 1.

Hereinafter, an embodiment of the present invention is described with reference to the drawings.

First Embodiment

In a hospital, a nursing and healthcare facility for elderly people and the like, a nurse or a staff member visits rooms of patients or elderly people to change their diapers. Under this circumstance, a waste sealing apparatus according to the present embodiment is applied to a diaper changing cart for carrying unused disposable diapers and towels to change diapers of the patients or the elderly people and for collecting and discarding changed used disposable diapers and/or towels. It should be noted that this waste sealing apparatus may be used for discarding various medical wastes such as bandages, absorbent cottons, gauze, gloves, syringes and ampoules which are stained with blood and the like in a medical institution, household garbage, used disposable diapers for babies and the like.

As illustrated in FIGS. 1 to 14, the waste sealing apparatus according to this embodiment includes a supply mechanism 1 which supplies sealing sheets S in a opposed fashion, a pressure bonding mechanism 2 for the opposed sealing sheets S, and a cutting mechanism 3 for the sealing sheets S. When a waste 4 is thrown in between the opposed sealing sheets S, the opposed sealing sheets S are bonded to each other by the pressure bonding mechanism 2 and then cut by the cutting mechanism 3.

In order to enable the bonding by the pressure bonding mechanism 2 and the cutting by the cutting mechanism 3 described above to be automatically performed when the waste 4 is thrown in, this waste sealing apparatus includes a throw-in checking sensor 5 provided on an insertion side of the pressure bonding mechanism 2, and a passage checking sensor 6 provided on a discharge side of the pressure bonding mechanism 2. In order to prevent the sealed waste from being caught in the pressure bonding mechanism 2, this waste sealing apparatus further includes a catch-in preventing sensor 7 provided on the discharge side of the pressure bonding mechanism 2.

Various sensors such as a mechanical sensor, a magnetic sensor and a photoelectric sensor can be used as the above-mentioned sensors. In the present embodiment, a photoelectric sensor (produced by Keyence Corporation, product name: PZ-G61N) which utilizes infrared rays is used, and a light transmitting part and a light receiving part thereof are positioned opposed to each other and used as a pair. All of the sensors can sense an infrared ray transmitted from the light transmitting part to the light receiving part, and function as switches for activating and stopping the pressure bonding mechanism 2 and the cutting mechanism 3.

That is, the waste 4 which has been thrown in from a throw-in port 81 is placed on pressure bonding rolls 21, and hence the infrared ray which is transmitted from the light transmitting part to the light receiving part of the throw-in checking sensor 5 is blocked, so that the throw-in checking sensor 5 senses that the waste 4 has been thrown in from the throw-in port 81. Further, when the waste 4 sealed by the sealing sheets S is discharged from the pressure bonding rolls 21, the infrared ray which is transmitted from the light transmitting part to the light receiving part of the passage checking sensor 6 is blocked, so that the passage checking sensor 6 senses that the waste 4 has been discharged from the pressure bonding rolls 21. Still further, when the waste 4 sealed by the sealing sheets S has been discharged from the pressure bonding rolls 21, but does not advance downwardly of the pressure bonding rolls 21, instead to start to cling to and be caught in the pressure bonding rolls 21, the infrared ray which is transmitted from the light transmitting part to the light receiving part of the catch-in preventing sensor 7 is blocked, so that the catch-in preventing sensor 7 senses that the sealed waste has started to be caught in the pressure bonding rolls 21.

Further, when the throw-in checking sensor 5 senses the thrown-in waste 4, the pressure bonding mechanism 2 starts to operate. In addition, when the passage checking sensor 6 senses the sealed waste 4, the cutting mechanism 3 starts to operate. Then, when the catch-in preventing sensor 7 senses the sealing sheet S or the sealed waste 4, the operation of the pressure bonding mechanism 2 is stopped. When the catch-in preventing sensor 7 senses the sealed waste 4 or the like, the catch-in preventing sensor 7 may be linked to a informing mechanism to give the outside such as a warning sound and a warning light.

The sealing sheet S may include a wrapping base material and a bonding layer (an adhesive layer) provided thereon, and have gas barrier properties in the wrapping base material and the bonding layer (adhesive layer), so that waste 4 is wrapped and covered with the wrapping base material and is sealed by the bonding layer (adhesive layer). For the wrapping base material, it is preferable to use a base material such as a plastic film and a plastic sheet which passes through infrared rays used in various sensors. The gas barrier properties in the wrapping base material and the bonding layer may be obtained by imparting the properties to the wrapping base material itself, to the bonding layer, or the wrapping base material and the bonding layer by the synergistic interaction therebetween. The bonding layer may be an adhesive layer and the like having a slightly sticky touch at room temperature. In the present embodiment, an adhesive layer (thickness of 5 μm) made of a polyester-polyurethane resin (produced by Sanyo Chemical Industries, Ltd., product name: SANPRENE IB-129) is integrally laminated on one surface of a wrapping base material (thickness of 25 μm) made of a cast polypropylene (CPP) film, and the sheet thus obtained is used as the sealing sheet S (width of 450 mm×length of 100 m). The sealing sheet S is unrollably rolled up.

Figure 6:
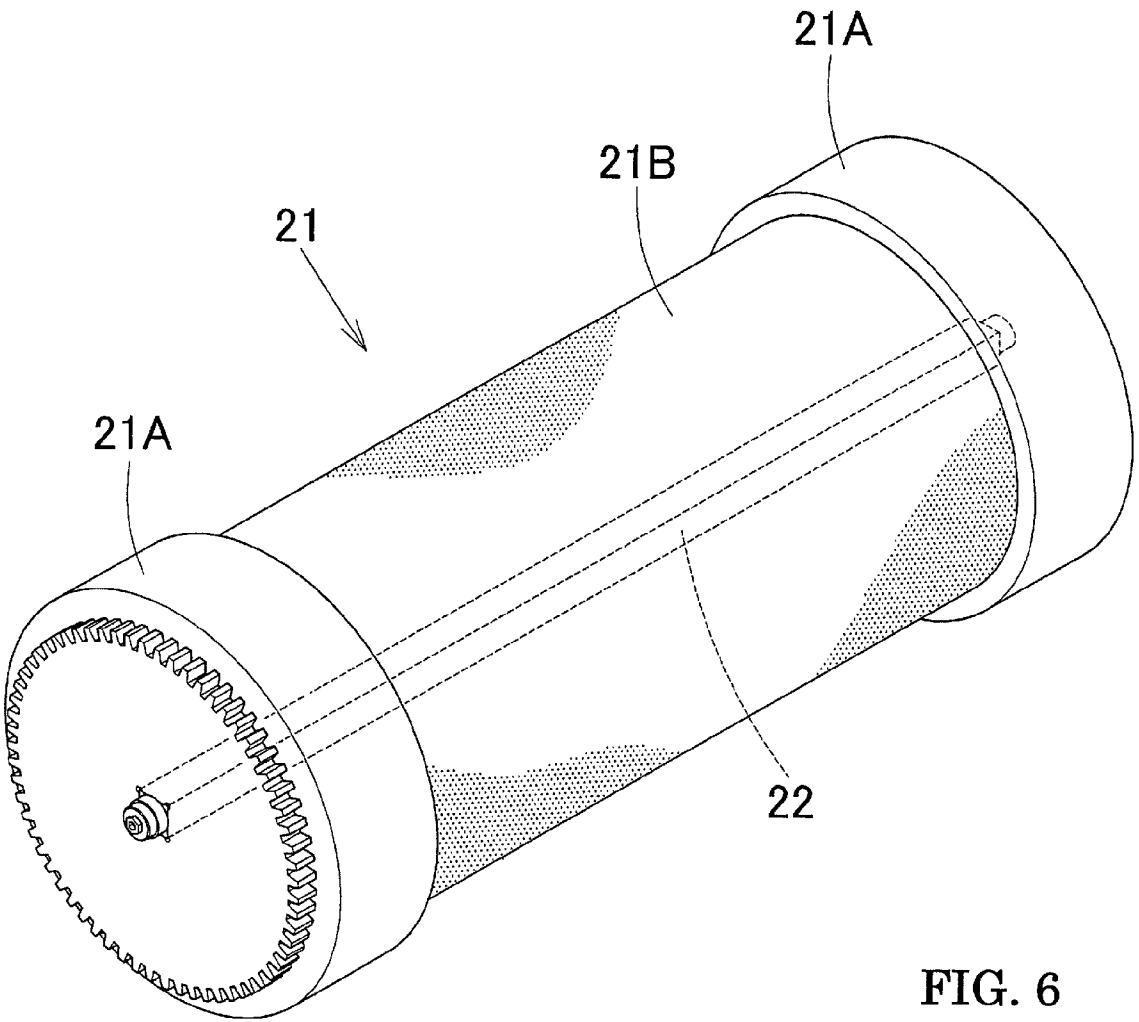
FIG. 6 is a perspective view of a pressure bonding roll (one side) of the waste sealing apparatus of FIG. 1.
Figure 7:
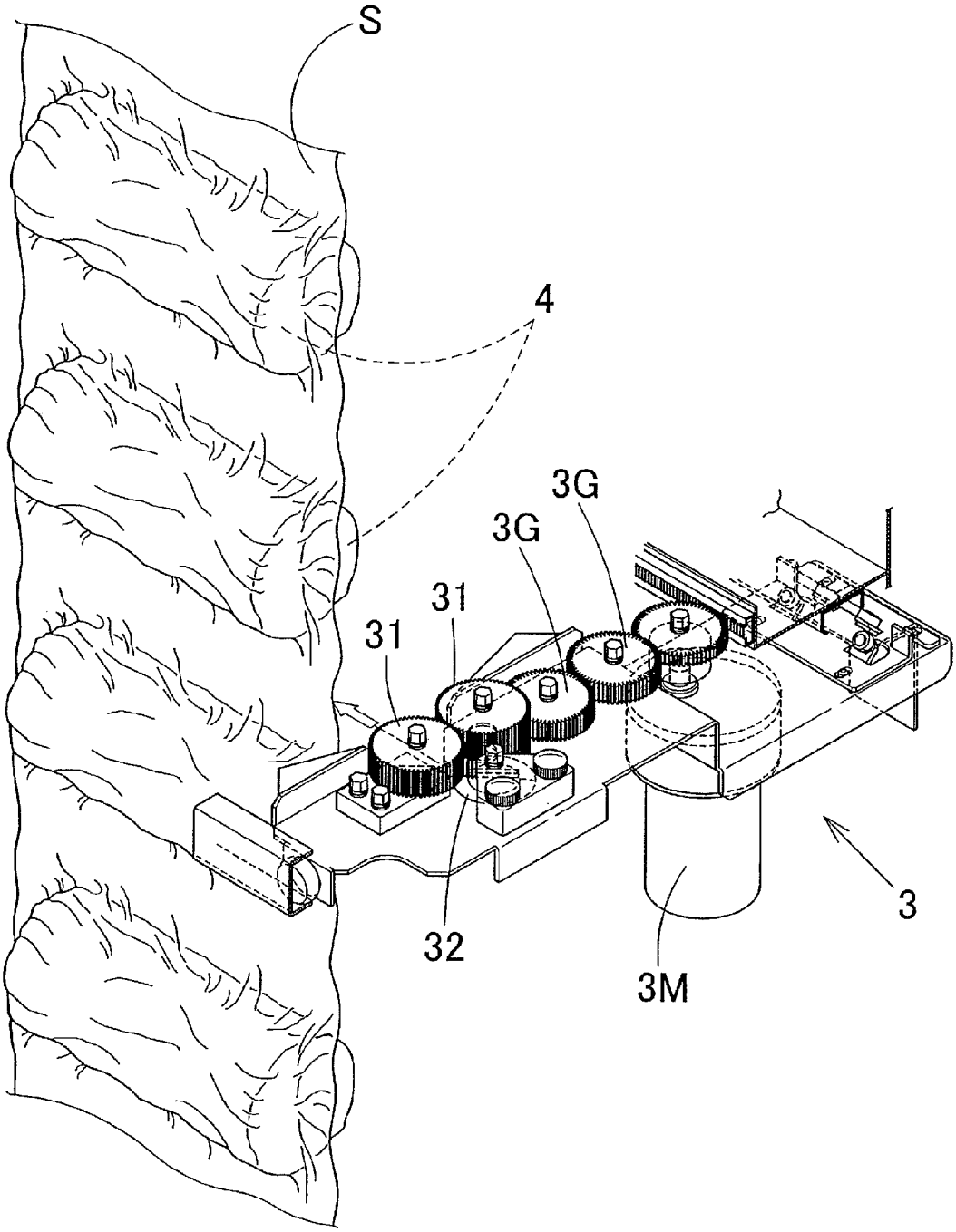
FIG. 7 is a partially cutaway perspective view for illustrating a cutting mechanism for sealing sheets of the waste sealing apparatus of FIG. 1.
Figure 8:
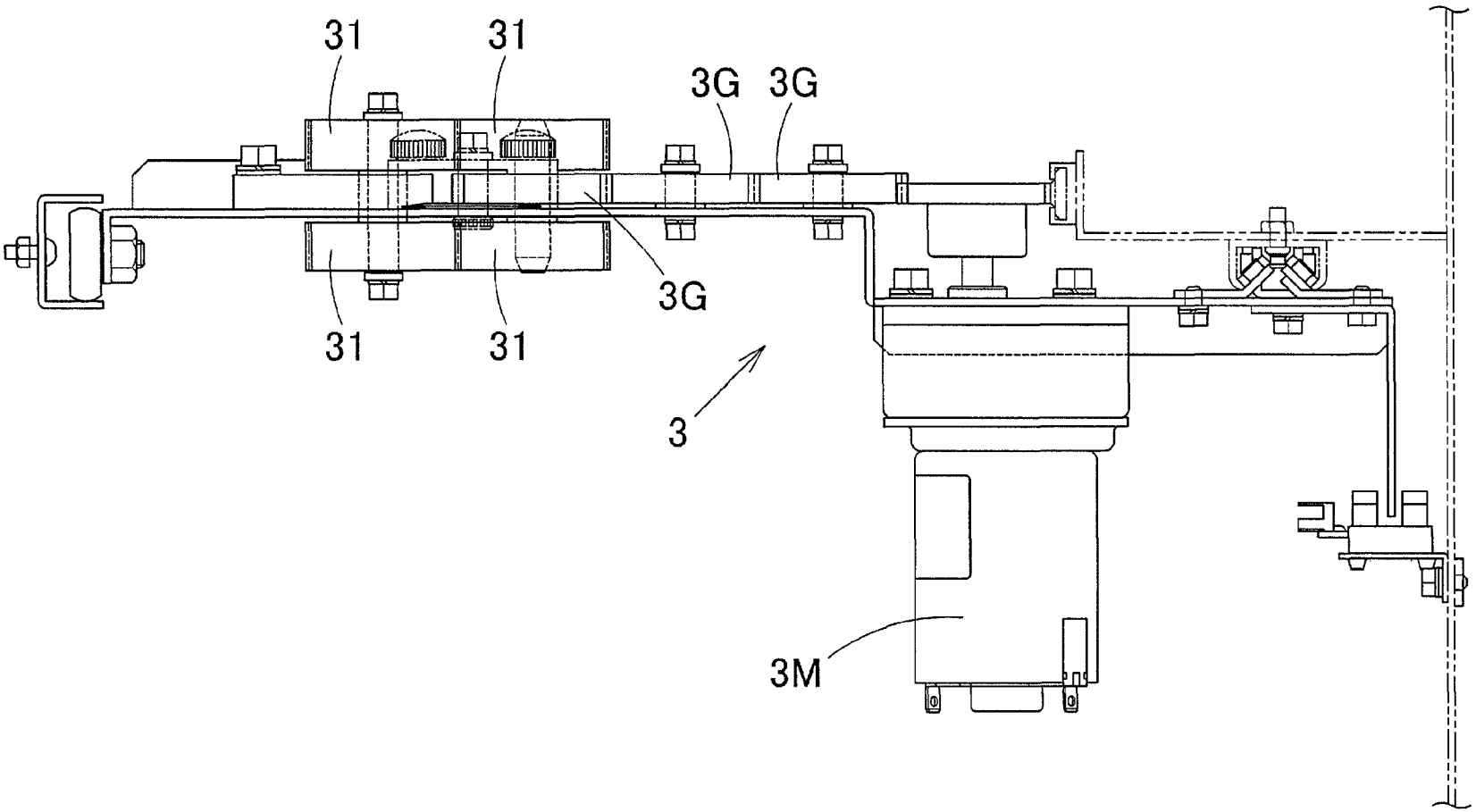
FIG. 8 is a front view of the cutting mechanism of the waste sealing apparatus of FIG. 1.
Figure 9:
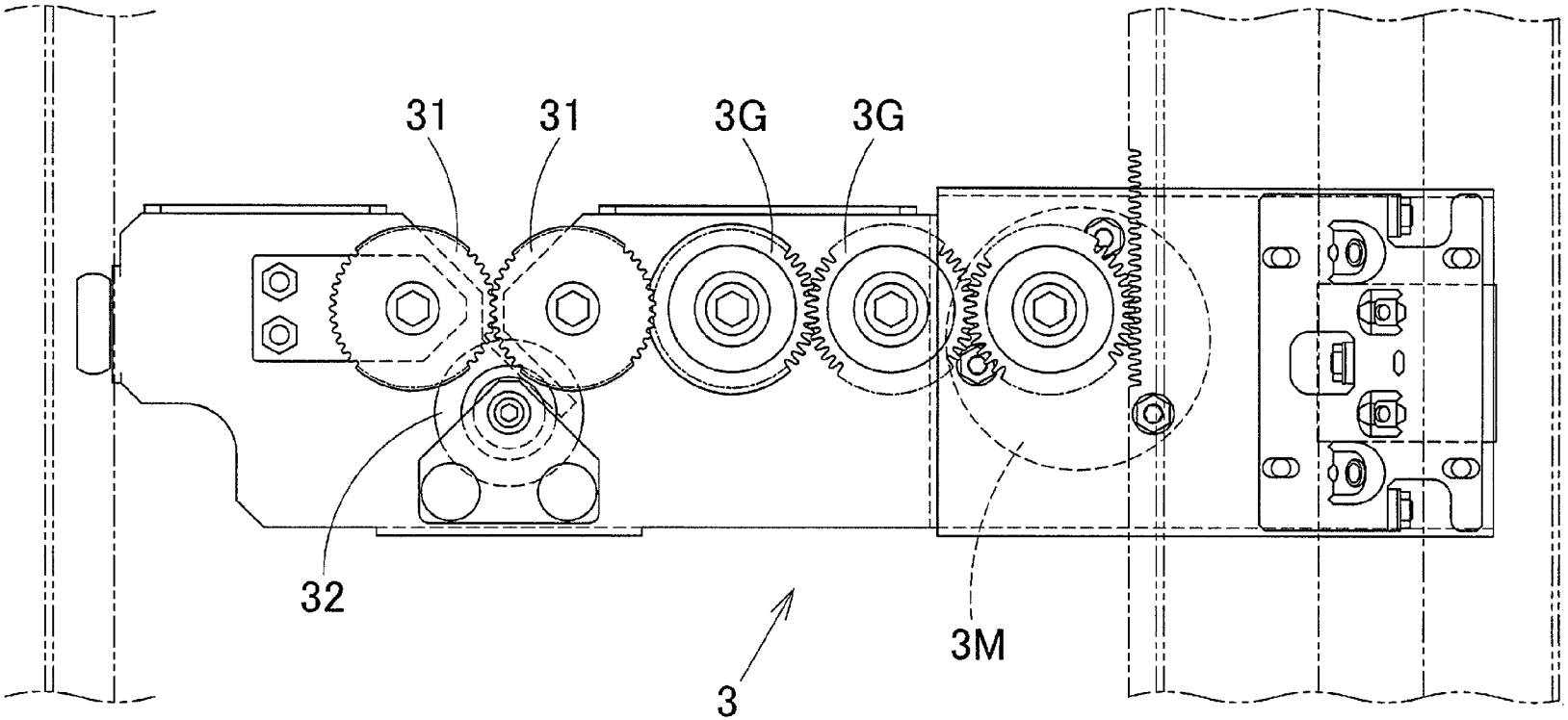
FIG. 9 is a plan view of the cutting mechanism of the waste sealing apparatus of FIG. 1.
Figure 10:
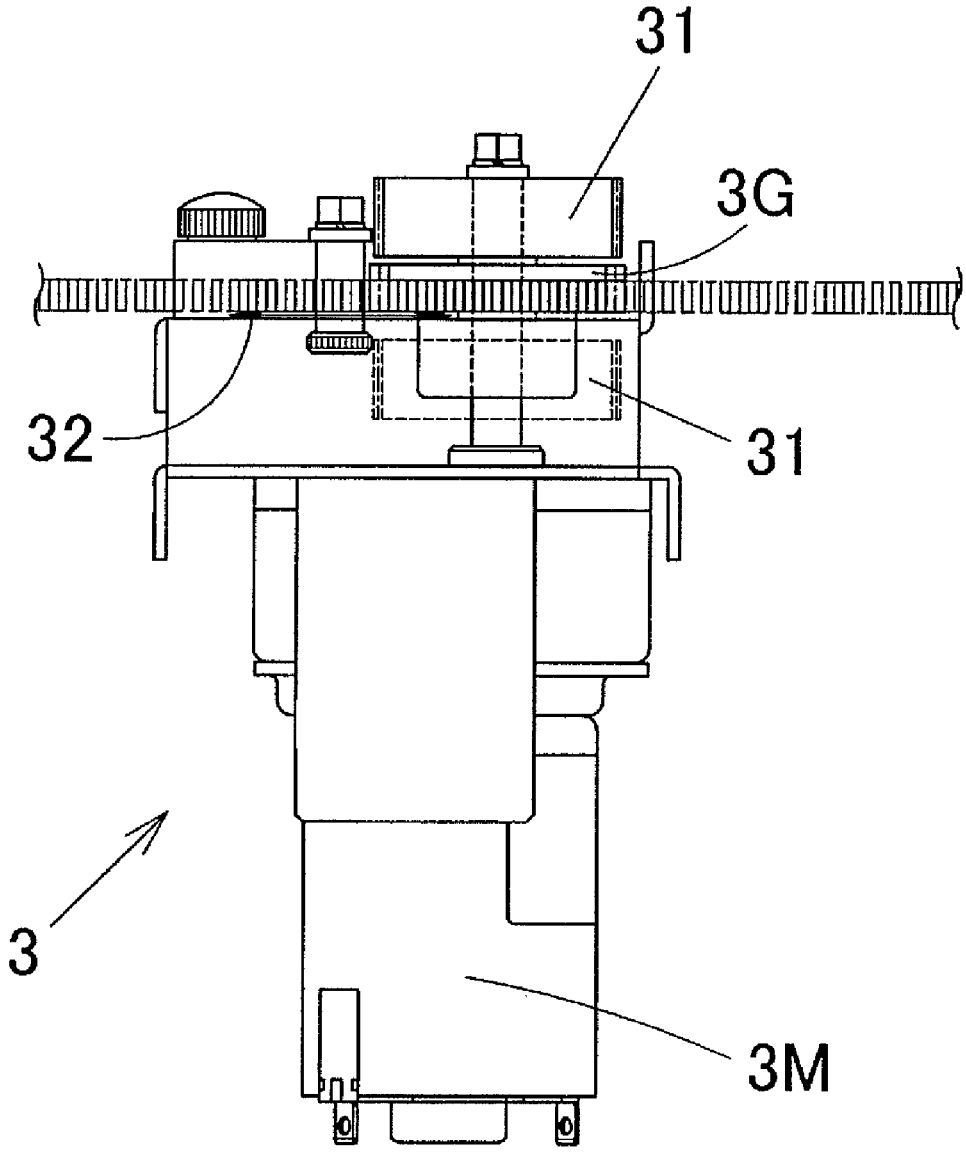
FIG. 10 is a right side view of the cutting mechanism of the waste sealing apparatus of FIG. 1.
Figure 11:
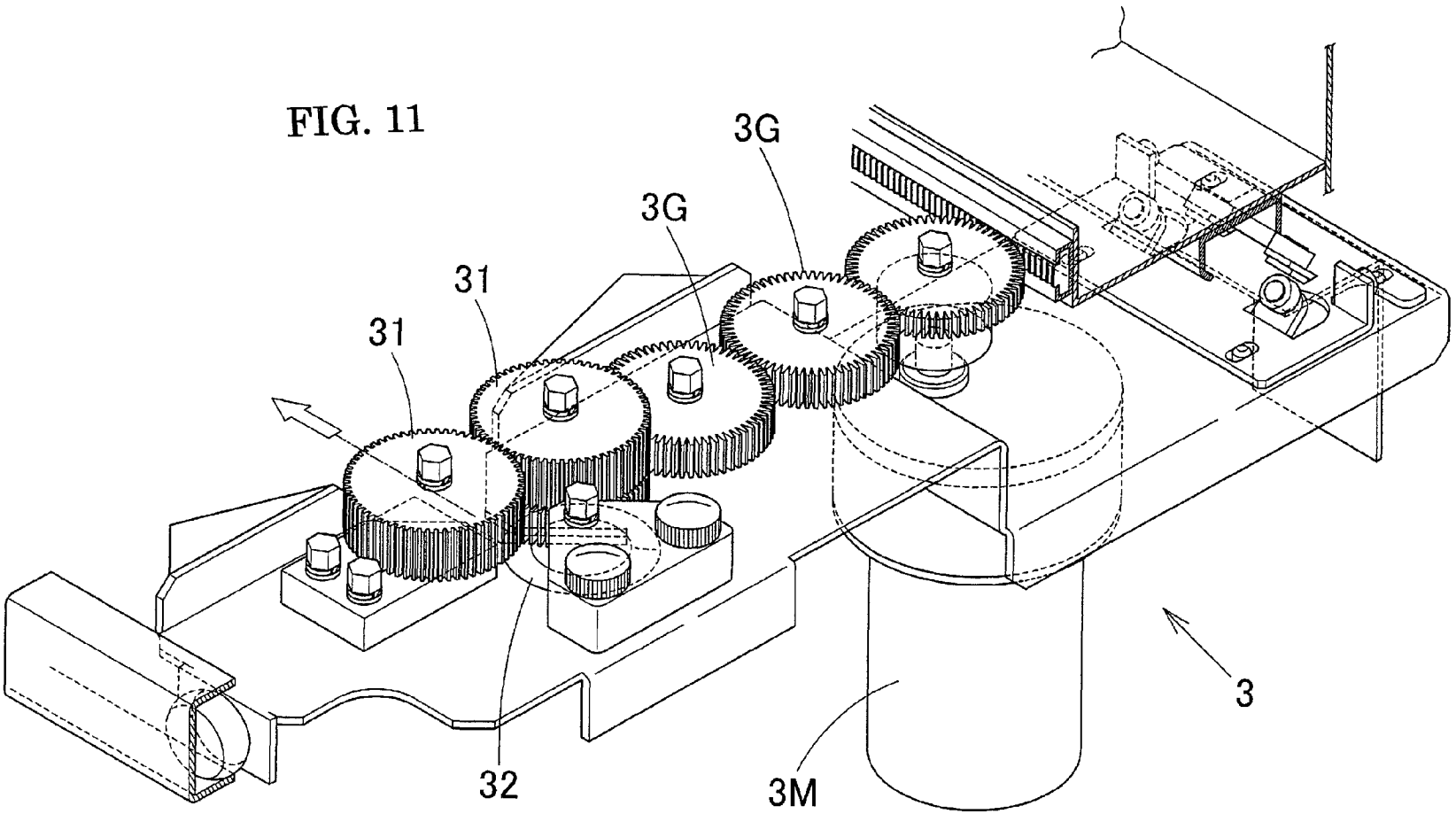
FIG. 11 is a perspective view of the cutting mechanism of the waste sealing apparatus of FIG. 1.
Figure 12:
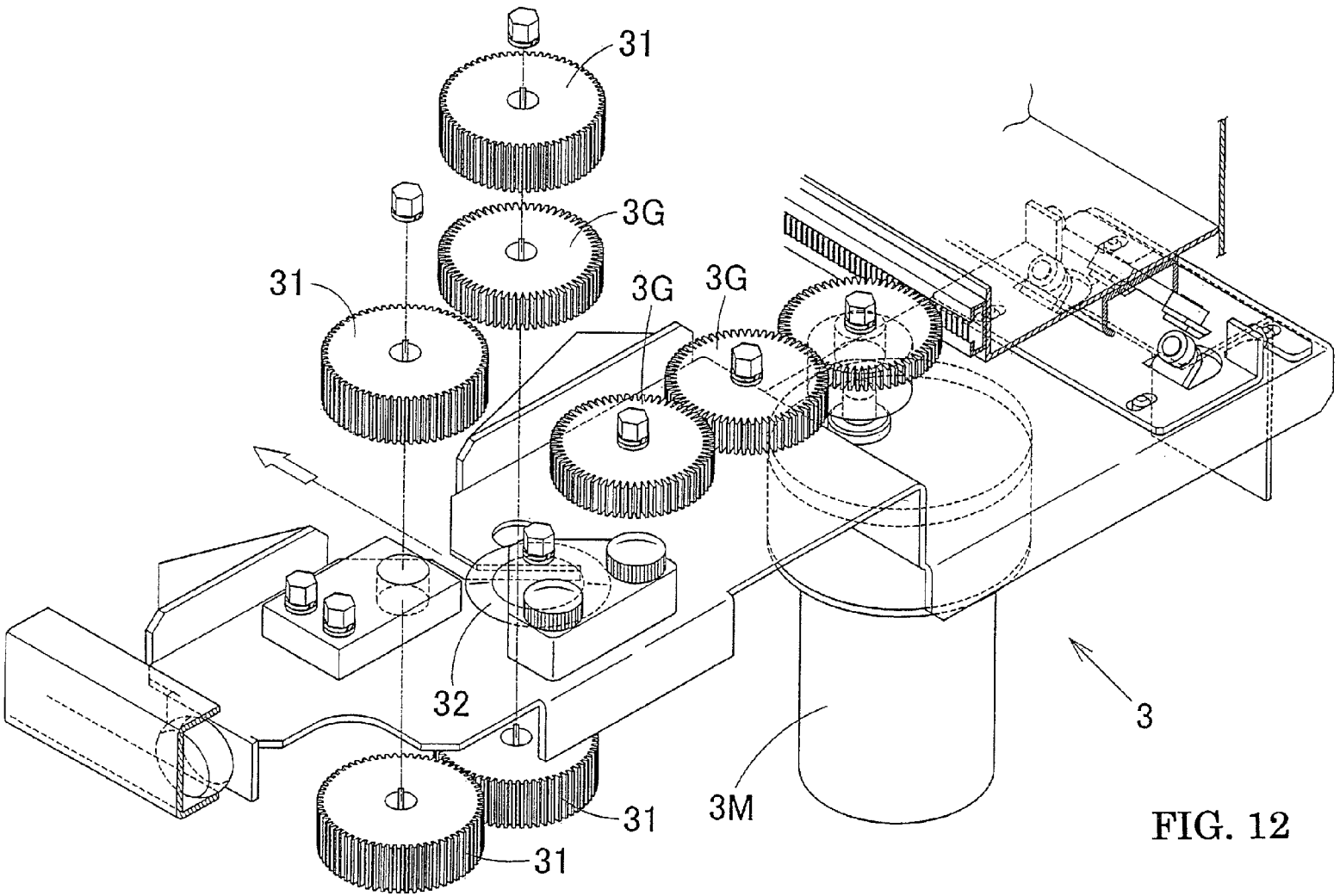
FIG. 12 is an exploded perspective view of the cutting mechanism of the waste sealing apparatus of FIG. 1.

The pressure bonding mechanism 2 for the opposed sealing sheets S includes the pressure bonding rolls 21 and a drive mechanism therefor. As illustrated in FIG. 6, the pressure bonding roll 21 has seal parts 21A provided at both ends, each of them having a columnar shape with a diameter of 190 mm (thickness of 55 mm) and being made of a urethane sponge, and an elastic compression part 21B provided between the seal parts 21A, which has a columnar shape with a diameter of 170 mm (thickness of 340 mm) and is made of a urethane sponge. A metal shaft 22 is inserted through the central axis of each of seal parts 21A and an elastic compression part 21B. The diameter of the seal parts 21A is larger than the diameter of the elastic compression part 21B.

Here, the seal parts 21A may be made of metal which can be subjected to various surface treatments, hard polymeric materials such as resins, and polymeric materials having an elastic force such as butadiene rubber and silicon rubber. Further, the elastic compression part 21B may be made of polymeric materials having an elastic force such as butadiene rubber and silicon rubber. With the structure stated above, the seal parts 21A of the pressure bonding rolls 21 reliably seal both ends of the sealing sheets S, and the elastic compression parts 21B also bring the opposed sealing sheets into contact, and thereby the sheets are bonded together. Further, when the elastic compression part 21B is made of a material having an elastic force, even if the waste 4 bites into this part to some degree, the elastic compression part 21B can deform to tolerate the biting. Therefore, unlike this part being made of metal, the elastic compression part 21B can prevent the apparatus from an emergency stop. Further, the sealing sheets S are sealed by the seal parts 21A provided at the both ends and having the diameter lager than that of the elastic compression parts 21B, and hence the waste 4 is not squeezed out, and further a sealing at the both ends can be highly secured. Still further, the structure with no elastic compression part 21B may allow the apparatus continuously to operate even if a plurality of wastes 4 are intermittently supplied or a waste 4 having a long length is supplied.

In addition, the drive mechanism for the opposed pressure bonding rolls 21 causes a motor 2M to rotationally drive the opposed pressure bonding rolls 21 via a gear 2G. Then, the seal parts 21A and the elastic compression parts 21B of the opposed pressure bonding rolls 21 strongly press the bonding layers (adhesive layers) of the sealing sheets S against each other for sealing.

This waste sealing apparatus is incorporated in a diaper changing cart to be freely carried from a sickroom to another sickroom. Therefore, the motor 2M and the like are driven by batteries, and used disposable diapers and the like which have been changed and sealed by the sealing sheets S are temporarily kept in an opening part 83 provided in a lower portion of the cart. It should be noted that the electrical circuits of the apparatus may be appropriately modified to be used around the world as a stationery type and driven at AC 100 V power or AC 120 V power.

As illustrated in FIGS. 7 to 12, the cutting mechanism 3 for the sealing sheets S includes an upper set and a lower set of opposed attaching gears 31 (that is, four of the attaching gears 31), and a cutting blade 32 which is interposed between the upper and lower attaching gears 31. The upper and lower attaching gears 31 which are rotationally driven by the motor 3M via the gear 3G sandwich therebetween one end part of the sealing sheets S—from both front and rear—discharged from the pressure bonding rolls 21 and advance to a central part and then another end part of the sealing sheets S. Further, the cutting blade 32 which follows the advance of the attaching gears 31 starts to cut the sealing sheets S sandwiched between the attaching gears 31 from the one end part thereof, and further cuts the sealing sheets S to the central part and then the other end part thereof. It should be noted that, in the embodiment, spur gears having teeth parallel to the rotation axis are used as the attaching gears 31, and alternatively, helical gears having teeth inclined to the rotation axis may be also used for the purpose of reduction in operating noise and enhancement in sealing between the sealing sheets.

With the construction stated above, the sealing sheets S are cut by the cutting blade 32 while being sandwiched between the upper and lower attaching gears 31, and hence the sealing sheets S can be cut from an end edge thereof, which leads to shortening of cutting time. In addition, the cutting blade 32 is sandwiched between the upper and lower attaching gears 31 and not exposed, a user can prevent his or her hand from mistakenly injuring when putting the hand in the apparatus.

In addition, a photoelectric sensor (produced by OMRON Corporation, product name: EE-SX12321A-P2) which utilizes infrared rays is provided in the cutting mechanism 3, so that, in case the attaching gears 31 is likely to sandwich the sealed waste therebetween, the pressure bonding rolls 21 are rotated and the portion of only the pressure-bonded sealing sheets S with no waste being present is cut. With this structure, the pressure-bonded sealing sheets S between one sealed waste and another sealed waste can be cut, and hence it is possible to prevent the cutting blade 32 from rusting which is caused by the contact between the waste and the cutting blade 32. Therefore, exchange of cutting blades 32 are less necessary, which leads to reduction in exchange work and cost. Further, for the operation of the cutting mechanism 13, it is possible to select an operation mode in which the sealed waste can be cut one by one, some at a time, or at arbitrary timing according to a user's desire.

A power switch (not shown) for switching between turning on/off of power supply to the apparatus and a charging plug connection part (not shown) for charging from an external power supply are provided on a side surface of an apparatus main body.

Figure 13:
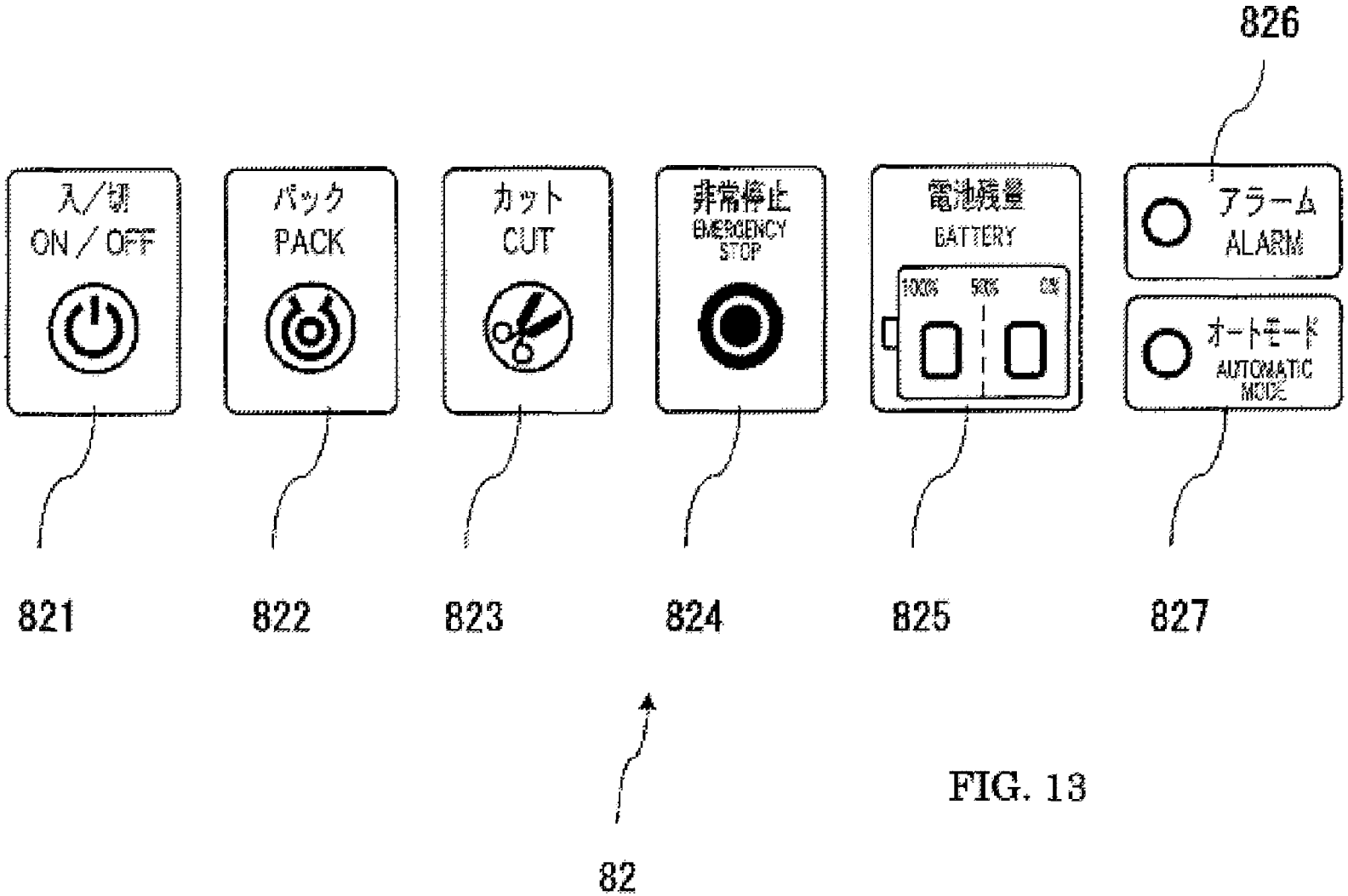
FIG. 13 illustrates an operation panel of the waste sealing apparatus of FIG. 1.
Figure 14:
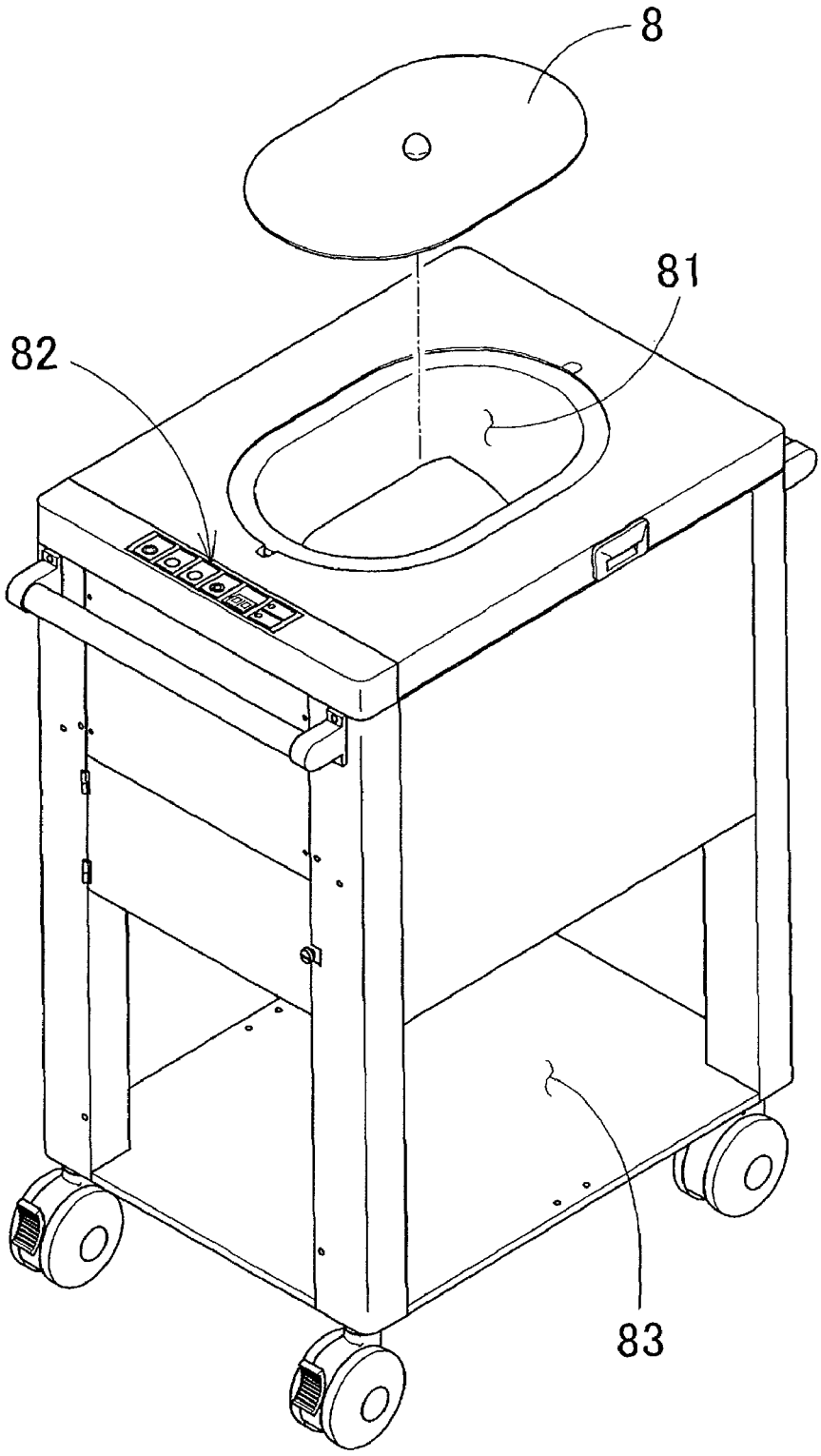
FIG. 14 is an overall perspective view of the waste sealing apparatus of FIG. 1.
Figure 15:
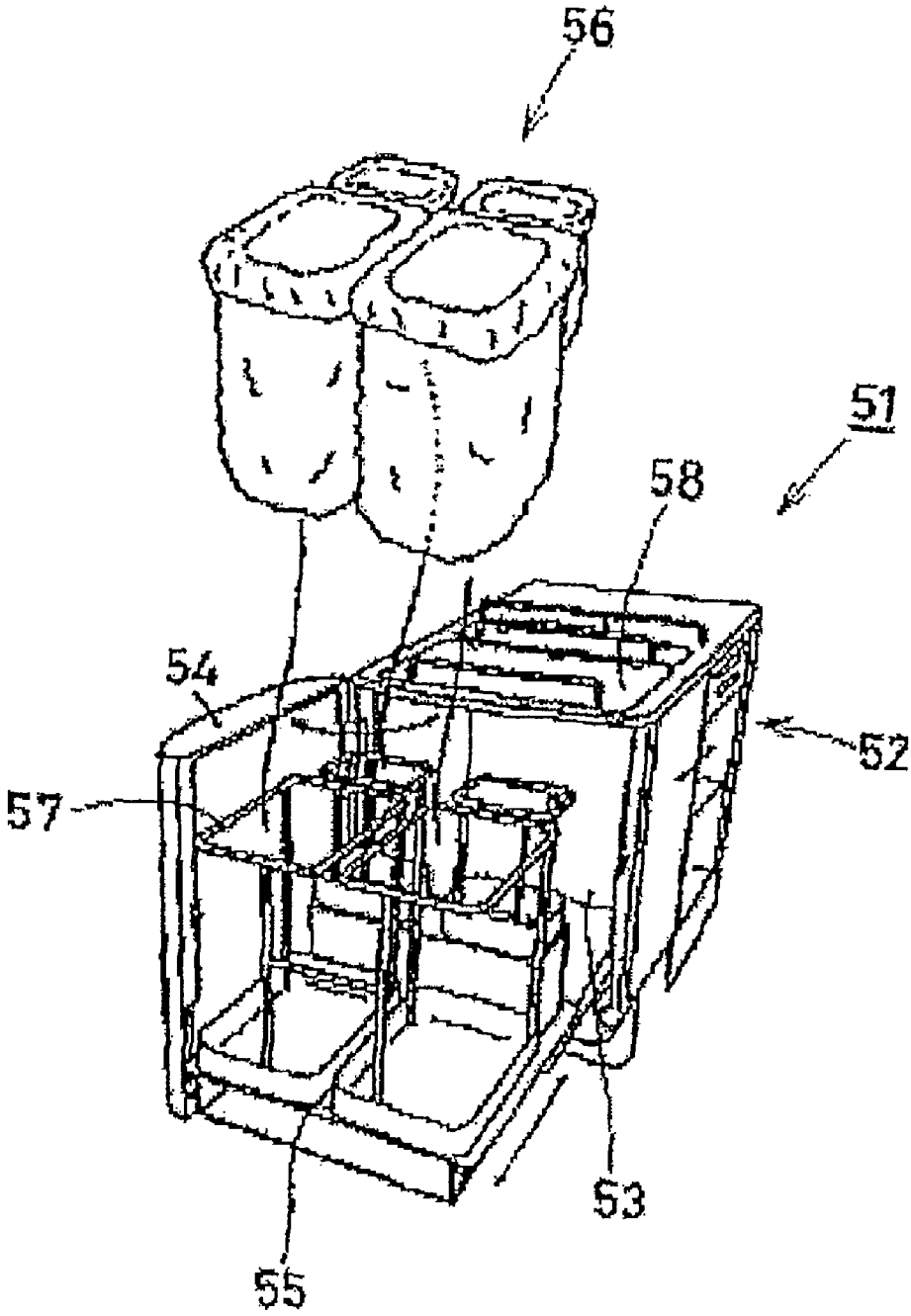
PRIOR ART FIG. 15
FIG. 15 is a perspective view illustrating a conventional diaper changing cart.
Figure 16:
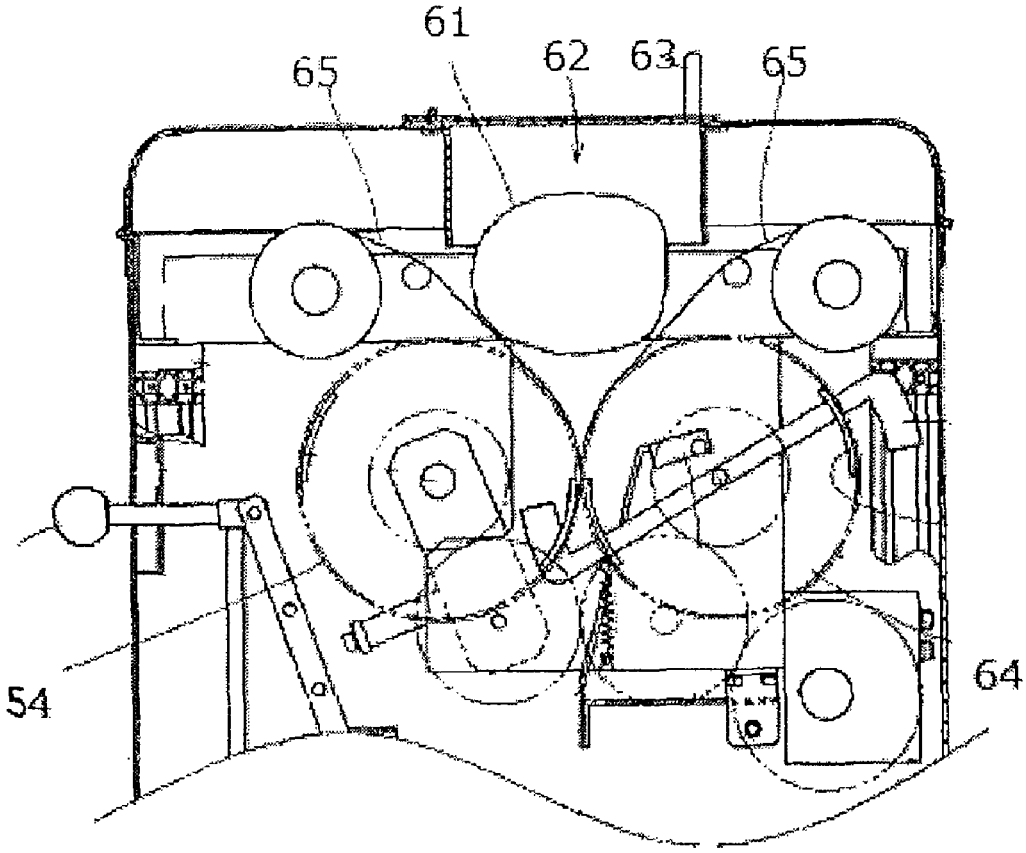
PRIOR ART FIG. 16
FIG. 16 is a perspective view illustrating another conventional waste sealing apparatus.

As illustrated in FIG. 13, an operation panel 82 is provided on an upper cover of the apparatus main body, and includes an ON/OFF switch 821 for switching between turning on/off of a stand-by state in order to prevent power from being wasted and consumed, a PACK switch 822 for rotating the pressure bonding rolls 21 to feed the sealing sheets S, a CUT switch 823 for automatically cutting the sealing sheets S after sealing, an EMERGENCY STOP switch 824 for bringing the pressure bonding rolls 21 and the cutting mechanism 3 into an emergency stop, a BATTERY display 825 for displaying, on two right and left display parts, a remaining battery level of a battery incorporated in the apparatus, an ALARM display 826 which flashes on and off in red when the apparatus detects malfunction, and an AUTOMATIC MODE display 827 which lights up or flashes on and off in yellow when an arbitrary automatic mode is selected. In the BATTERY display 825, the state where both of the two right and left display parts light up in red indicates that the remaining battery level is sufficiently high, the state where only the right display part lights up in red indicates that charging is necessary, and the state where only the right display part go on and off in red indicates that immediate charging is necessary.

This waste sealing apparatus operates in a normal mode, an automatic mode I, an automatic mode II, or an automatic mode III, as follows.

<Normal Mode>

The power switch is pressed to an ON side, so that the apparatus is powered and brought into an operable state. Then, a cover 8 is removed, the waste 4 (used disposable diapers and the like) is put in the throw-in port 81 in a horizontal posture, the PACK switch 822 is pressed, then the PACK switch 822 shifts from lighting to flashing on and off. During the PACK switch 822 being pressed, the sealing sheets S are fed to the pressure bonding rolls 21, and the pressure bonding rolls 21 continue to press the opposing sealing sheets S. When the CUT switch 823 is pressed, the pressure-bonded sealing sheets are fed to a position where the automatically sealed waste and the cutting blade 32 do not come into contact with each other, and then the cutting mechanism 3 cuts the pressure-bonded sealing sheets S. When an unused state lasts for 30 minutes, the apparatus becomes on standby, where the ON/OFF switch 821 slowly goes on and off while other displays turn off. Further, in order to bring the apparatus again into the operable state, the ON/OFF switch 821 is pressed. In addition, the time length of 30 minutes of non-use condition until the apparatus enters the stand-by state is an initially set value, and it is possible to set the time length from 1 to 60 minutes at intervals of one minute at a user's discretion. The stand-by state denotes the state while the apparatus is powered off in order to reduce power consumption, and the apparatus has a function to save the condition just before the apparatus is powered off so as to enable the apparatus to restart with that condition when the power is on.

<Automatic Mode I>

The automatic mode I is a mode in which, when a waste 4 is put in the throw-in port 81 and the PACK switch 822 is then pressed, only an operation of automatically sealing the waste 4 with the sealing sheets S is performed. In order to set the apparatus to the automatic mode I, the power switch (not shown) is pressed to the ON side while the ON/OFF switch 821 and the PACK switch 822 are being pressed for at least 3 seconds. Then, the right display part of the BATTERY display 825 goes on and off, and the apparatus enters the stand-by state. Here, the ON/OFF switch 821 being pressed, the stand-by state is released, the ON/OFF switch 821 lights up, and the apparatus enters the operable state. When the waste 4 is put in the throw-in port 81 and the PACK switch 822 is then pressed, the waste 4 is automatically sealed with the sealing sheets S. In order to cut away the continuously discharged sealed wastes 4 by an appropriate number, the CUT switch 823 is pressed at an arbitrary timing, then the pressure-bonded sealing sheets are automatically fed to a position suitable for cutting, and there cut by the cutting mechanism (3).

<Automatic Mode II>

The automatic mode II is a mode in which, when a waste 4 is put in the throw-in port 81, the throw-in checking sensor 5 senses the waste 4, and the operation of automatically sealing the waste 4 with the sealing sheets S is performed. In order to set the apparatus to the automatic mode II, the power switch (not shown) is pressed to the ON side while the ON/OFF switch 821 and the CUT switch 823 are being pressed for at least 3 seconds. Then, the left display part of the BATTERY display 825 goes on and off, and the apparatus enters the stand-by state. When the ON/OFF switch 821 is pressed, the stand-by state is released, the ON/OFF switch 821 lights up, and the apparatus enters the operable state. Then, when the waste 4 is put in the throw-in port 81, the waste 4 is automatically sealed with the sealing sheets S. In order to cut away the continuously discharged sealed wastes 4 by an appropriate number, the CUT switch 823 is pressed at an arbitrary timing, then the pressure-bonded sealing sheets are automatically fed to a position suitable for cutting, and there cut by the cutting mechanism (3).

<Automatic Mode III>

The automatic mode III is a mode in which, when a waste 4 is put in the throw-in port 81, the throw-in checking sensor 5 senses the waste 4, the waste 4 is automatically sealed with the sealing sheets S, and the pressure-bonded sealing sheets S are automatically cut. In order to set the apparatus to the automatic mode III, the power switch (not shown) is pressed to the ON side while the ON/OFF switch 821, the PACK switch 822 and the CUT switch 823 are being pressed for at least 3 seconds. Then, the right and left display parts of the BATTERY display 825 go on and off, and the apparatus enters the stand-by state. When the ON/OFF switch 821 is pressed, the stand-by state is released, the ON/OFF switch 821 lights up, and the apparatus enters the operable state. Here, when the wastes 4 are put in the throw-in port 81, the respective wastes 4 are automatically sealed with the sealing sheets S, the sealed wastes 4 are automatically discharged from the pressure bonding rolls 21 and cut away one after another.

In order to return the apparatus in the automatic mode I, II or III to the normal mode, the power switch (not shown) is turned on with the EMERGENCY STOP switch 824 being pressed.

How to use the waste sealing apparatus according to the present embodiment is described below.

With this waste sealing apparatus, wastes 4 (used disposable diapers and the like) can be put in between the opposed sealing sheets S to be bonded together by the pressure bonding mechanism 2, and hence the respective wastes 4 can be sealed between the sealing sheets S. Further, this waste sealing apparatus includes the throw-in checking sensor 5 and the passage checking sensor 6. Pressing the CUT switch 823 or setting the apparatus to the automatic mode III allow the sealing sheets S, not the wastes, to be cut by the cutting mechanism 3, and thereby unpleasant smells can be automatically and preferably prevented from emitting and floating therearound. The diaper changing cart incorporating this waste sealing apparatus is extremely suitable for nursing care. It is advantageous that stained and contaminated matters can be mechanically sealed, which is extremely more hygienic than ever, and that airborne infection is prevented by hermetically sealing and enclosing germs between the sealing sheets S, which contribute to the prevention of a nosocomial infection. Moreover, when the catch-in preventing sensor 7 senses that the sealing sheets S or sealed wastes 4 are about to be caught in the pressure bonding rolls 21, the operation of the pressure bonding mechanism 2 is stopped, which can reduce useless consumption of sealing sheets S and troubles of the apparatus.

In addition, the cutting mechanism 3 for sealing sheets S includes the opposed attaching gears 31 and the cutting blade 32. This provides an advantage that the cutting blade 32 moves from one end part to the other end part of the sealing sheets S while the sealing sheets S are stretched, and thereby smooth cutting is possible. Moreover, since the cutting blade 32 is provided between the upper and lower attaching gears 31, a user can be preferably prevented from inadvertent injury to his or her hand even when he or she puts his or her hand in the apparatus.

In addition, the sealing sheets S are sealed by the seal parts 21A which are provided on the both ends of the pressure bonding rolls and have the diameter lager than that of the elastic compression part 21B, which provides an advantage that waste 4 while being sealed does not squeezed out and a sealing at the both ends of the sealing sheets S can be guaranteed.

Incidentally, since used disposable diapers give off bad smells, are offensive and further unclean, discarding thereof has been a heavy burden on caregivers. In this regard, the apparatus according to the present invention has great significance, because used disposal diapers can be automatically sealed and cut away in an easy and hygienic manner, and easy and simple handling can reduce the burden on the caregivers.

What is claimed is:

1. A waste sealing apparatus comprising:

a supply mechanism of opposed sealing sheets;

a pressure bonding mechanism for the opposed sealing sheets;

a throw-in checking sensor provided on an insertion side of the pressure bonding mechanism;

a cutting mechanism for the opposed sealing sheets;

a passage checking sensor provided on a discharge side of the pressure bonding mechanism;

a catch-in preventing sensor provided on the discharge side of the pressure bonding mechanism;

the pressure bonding mechanism for the opposed sealing sheets having opposed bonding rolls each of which has seal parts on its both ends and a elastic compression part therebetween; wherein the throw-in checking sensor senses a thrown waste and then the supply mechanism of opposed sealing sheets is automatically activated, the pressure bonding mechanism activates the bonding rolls to bond the sealing sheets to seal the waste, the passage checking sensor senses the waste discharged from the pressure bonding mechanism and then the cutting mechanism automatically cut the bonded sealed sheets.

2. The waste sealing apparatus according to claim 1, wherein when sensing that the sealing sheets sealing the waste is caught in between the bonding rolls, the catch-in presenting sensor stops the operation of the bonding rolls.

3. The waste sealing apparatus according to claim 2, wherein the cutting mechanism has a cutting blade and opposed attaching gears which support the blade in cutting, the opposed attaching gears hold the bonded sealing sheets therebetween, and the cutting blade associated with the opposed attaching gears moves in a cutting direction.

4. The waste sealing apparatus according to claim 3, wherein the seal parts at both ends of each of the bonding rolls respectively have a diameter larger than that of the elastic compression part therebetween.

5. The waste sealing apparatus according to claim 2, wherein the seal parts at both ends of each of the bonding rolls respectively have a diameter larger than that of the elastic compression part therebetween.

6. The waste sealing apparatus according to claim 1, wherein the cutting mechanism has a cutting blade and opposed attaching gears which support the blade in cutting, the opposed attaching gears hold the bonded sealing sheets therebetween, and the cutting blade associated with the opposed attaching gears moves in a cutting direction.

7. The waste sealing apparatus according to claim 6, wherein the seal parts at both ends of each of the bonding rolls respectively have a diameter larger than that of the elastic compression part therebetween.

8. The waste sealing apparatus according to claim 1, wherein the seal parts at both ends of each of the bonding rolls respectively have a diameter larger than that of the elastic compression part therebetween.

* * * * *